US009478880B2

(12) United States Patent
Yokoyama

(10) Patent No.: US 9,478,880 B2
(45) Date of Patent: Oct. 25, 2016

(54) CONNECTOR HAVING PROJECTIONS FOR POSITIONING A CIRCUIT BOARD TO BE INSERTED IN THE CONNECTOR

(71) Applicant: JAPAN AVIATION ELECTRONICS INDUSTRY, LIMITED, Shibuya-ku, Tokyo (JP)

(72) Inventor: Yohei Yokoyama, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/606,020

(22) Filed: Jan. 27, 2015

(65) Prior Publication Data

US 2015/0214645 A1 Jul. 30, 2015

(30) Foreign Application Priority Data

Jan. 28, 2014 (JP) ..... 2014-013011

(51) Int. Cl.

| | |
|---|---|
| ***H01R 24/00*** | (2011.01) |
| ***H01R 12/70*** | (2011.01) |
| ***H01R 12/72*** | (2011.01) |
| ***H01R 13/629*** | (2006.01) |

(52) U.S. Cl.

CPC ..... *H01R 12/7005* (2013.01); *H01R 12/721* (2013.01); *H01R 13/629* (2013.01)

(58) Field of Classification Search

USPC ..... 439/374, 377, 630

See application file for complete search history.

(56) References Cited

U.S. PATENT DOCUMENTS

| | | | | |
|---|---|---|---|---|
| 6,350,143 | B2 * | 2/2002 | Kato | 439/297 |
| 6,361,350 | B2 * | 3/2002 | Johnson | 439/374 |
| 9,293,847 | B2 * | 3/2016 | Yokoyama et al. | H01R 13/64 439/377 |
| 2014/0220812 | A1 * | 8/2014 | Sasada | G06K 7/003 439/377 |

FOREIGN PATENT DOCUMENTS

| | | | |
|---|---|---|---|
| JP | 05174910 | A | 7/1993 |
| JP | 2003085524 | A | 3/2003 |
| JP | 2013093433 | A | 5/2013 |

* cited by examiner

*Primary Examiner* — Tho D Ta

(74) *Attorney, Agent, or Firm* — Holtz, Holtz & Volek PC

(57) ABSTRACT

A connector has a rear end in a front-rear direction and is connected with a circuit board when the circuit board is inserted into the connector through the rear end along the front-rear direction. The connector includes a plurality of contacts and a holding member holding the contacts. The holding member has two guide portions which are arranged away from each other in a pitch direction perpendicular to the front-rear direction. Each of the guide portions has an upper portion and a lower portion. In each of the guide portions, each of the upper portion and the lower portion intersects with an up-down direction perpendicular to both the front-rear direction and the pitch direction, and at least one of the upper portion and the lower portion is provided with a projection portion. In each of the guide portions, the projection portion projects inward in the up-down direction.

5 Claims, 8 Drawing Sheets

CONNECTOR HAVING PROJECTIONS FOR POSITIONING A CIRCUIT BOARD TO BE INSERTED IN THE CONNECTOR

CROSS REFERENCE TO RELATED APPLICATIONS

An applicant claims priority under 35 U.S.C. §119 of Japanese Patent Application No. JP2014-013011 filed Jan. 28, 2014.

BACKGROUND OF THE INVENTION

This invention relates to a connector which is to be connected to a rigid circuit board.

For example, Patent Document 1 discloses a connector of this type. As shown in FIGS. 12 and 13, the connector 900 of Patent Document 1 is a card edge connector which is to be connected to a circuit board 950. The connector 900 comprises a plurality of contacts 920 and a holding member 910 holding the contacts 920. The circuit board 950 has a plurality of conductive pads 960 formed in the vicinity of an end 952 thereof.

Since the connector 900 of Patent Document 1 is a card edge connector, each of the connector 900 and the circuit board 950 has a size which is sufficiently large in comparison with manufacturing tolerances for the circuit board 950. In general, such a card edge connector is designed to have an inner size with allowance in consideration of manufacturing tolerances for a circuit board. Accordingly, there is no problem even if the circuit board is moved in the general card edge connector within the manufacturing tolerances for the card edge connector upon the connection of the general card edge connector with the circuit board.

However, there is a case where a relay board, or a kind of the circuit board, is used to connect between contacts arranged with small pitches and cable conductors, respectively. In this case, since it is difficult to make manufacturing tolerances for the relay board smaller, positioning of the relay board in a connector should be performed with careful consideration of the manufacturing tolerances for the relay board.

Patent Document 1: JP2013-93433A, FIG. 5 (prior art in Patent Document 1)

SUMMARY OF THE INVENTION

It is therefore an object of the present invention to provide a connector which can improve positioning accuracy of a circuit board in the connector while considering manufacturing tolerances for the circuit board.

One aspect of the present invention provides a connector which has a rear end in a front-rear direction and is connected with a circuit board when the circuit board is inserted into the connector through the rear end along the front-rear direction. The connector comprises a plurality of contacts and a holding member holding the contacts. The holding member has a first guide portion and a second guide portion which are arranged away from each other in a pitch direction perpendicular to the front-rear direction. Each of the first guide portion and the second guide portion has an upper portion and a lower portion. In each of the first guide portion and the second guide portion, each of the upper portion and the lower portion intersects with an up-down direction perpendicular to both the front-rear direction and the pitch direction, and at least one of the upper portion and the lower portion is provided with a projection portion. In each of the first guide portion and the second guide portion, the projection portion projects inward in the up-down direction.

According to the present invention, since the projection portion is provided, a movement of the circuit board in the connector can be restricted.

Moreover, when the projection portion is provided to be away from a side surface in each of the first guide portion and the second portion, a space is formed between the projection portion and the side surface. If a circuit board of a large size, in particular, a circuit board which is thick in the up-down direction, is inserted into the connector, the circuit board is brought into abutment with the projection portions to deform them. As a result, the deformed projection portions securely hold the circuit board while the aforementioned spaces accommodate protruding parts of the deformed projection portions. Thus, the deformation of the projection portions can absorb manufacturing tolerances for the circuit board, more specifically, manufacturing tolerances in thickness of the circuit board, so that positioning accuracy of the circuit board in the connector can be improved.

An appreciation of the objectives of the present invention and a more complete understanding of its structure may be had by studying the following description of the preferred embodiment and by referring to the accompanying drawings.

Figure 1:
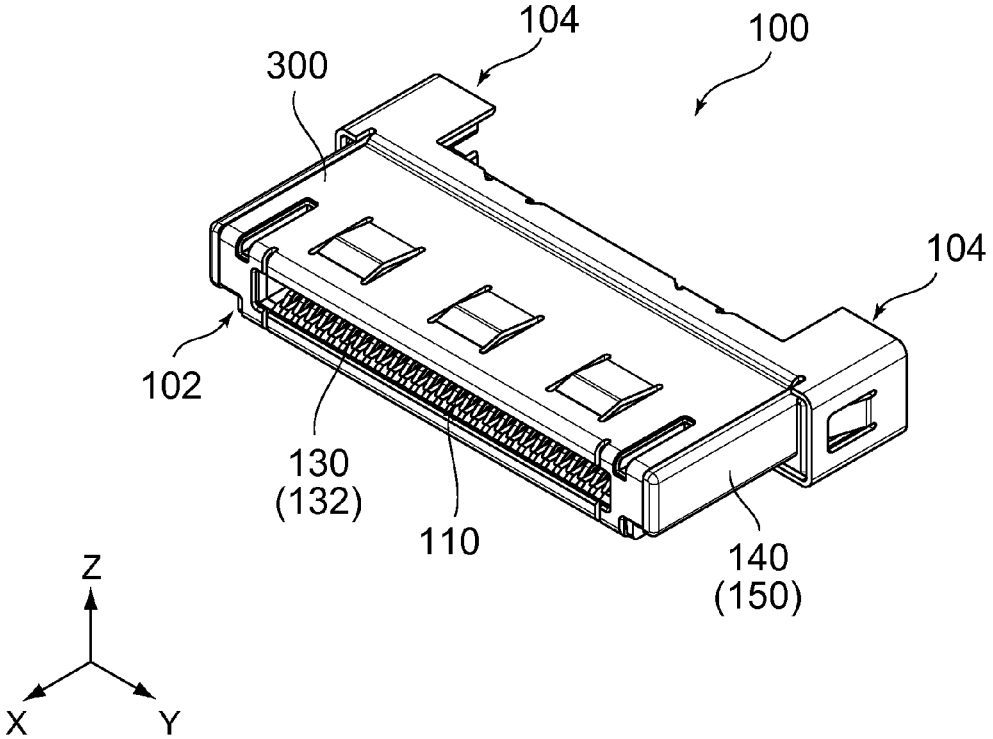
FIG. 1 is a front perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 5, a connector 100 according to an embodiment of the present invention includes a plurality of upper contacts (contacts) 120 and 120P each made of conductor, a plurality of lower contacts (contacts) 130 and 130P each made of conductor, a holding member 140 made of insulator and a shell 300 made of metal. The shell 300 partially covers the holding member 140. The holding member 140 holds the upper contacts 120 and 120P and the lower contacts 130 and 130P.

Figure 6:
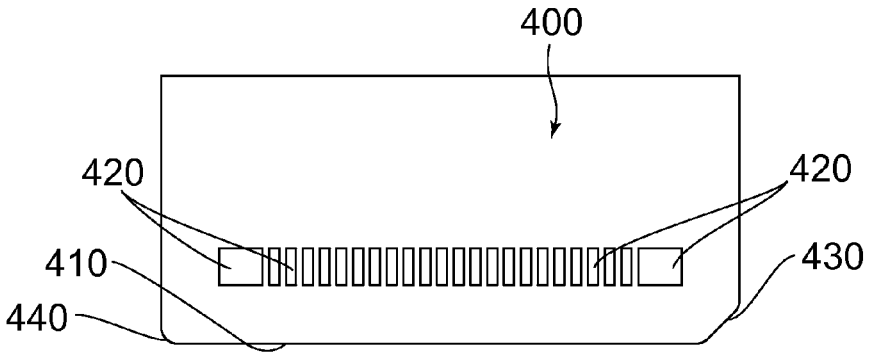
FIG. 6 is a top view showing the connector of FIG. 1 together with a circuit board.
Figure 6:
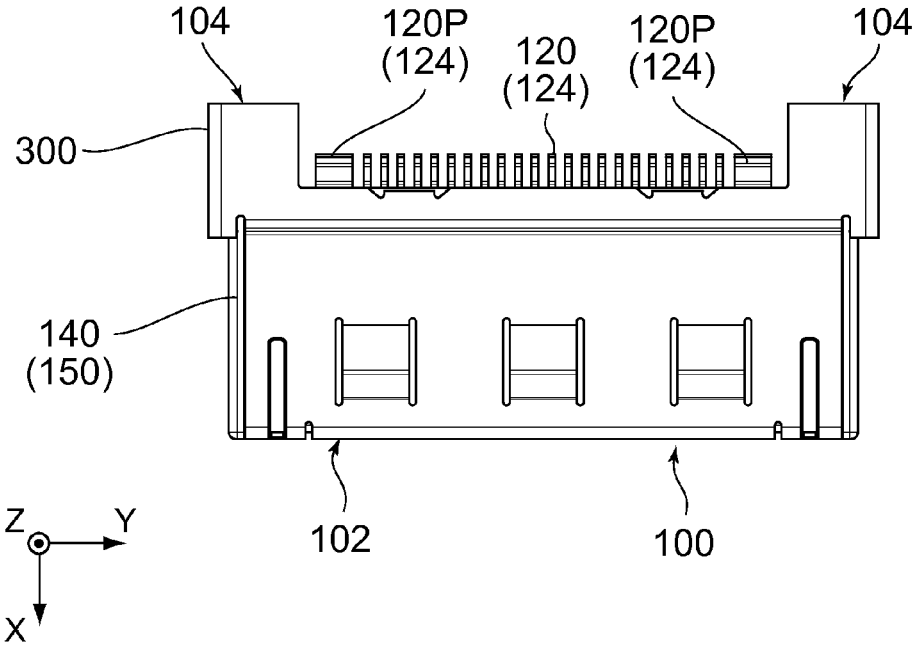

The connector 100 according to the present embodiment has a mating portion 110 which is to be mated with a mating connector (not shown). The mating portion 110 is located toward a front end 102 of the connector 100. Moreover, the connector 100 has a rear end 104 in a front-rear direction (X-direction). As can be seen from FIGS. 6 and 7, the connector 100 is connected with a circuit board 400 when the circuit board 400 is inserted into the connector 100 through the rear end 104 along the X-direction. The circuit board 400 according to the present embodiment is a relay board which is used to connect cable conductors (not shown) with the upper contacts 120 and 120P (see FIG. 6) and the lower contacts 130 and 130P (see FIG. 7). As shown in FIG. 6, the circuit board 400 according to the present embodiment is provided with a plurality of conductive pads 420 which correspond to the upper contacts 120 and 120P and the lower contacts 130 and 130P, respectively. The conductive pads 420 are formed in the vicinity of an end 410 of the circuit board 400. Moreover, the circuit board 400 has an insertion key 430 and a chamfer 440. The insertion key 430 is formed at one side of the end 410 of the circuit board 400 in the pitch direction (Y-direction) and obliquely intersects with the X-direction and the Y-direction. The chamfer 440 is formed at another side of the end 410 in the Y-direction.

Figure 5:
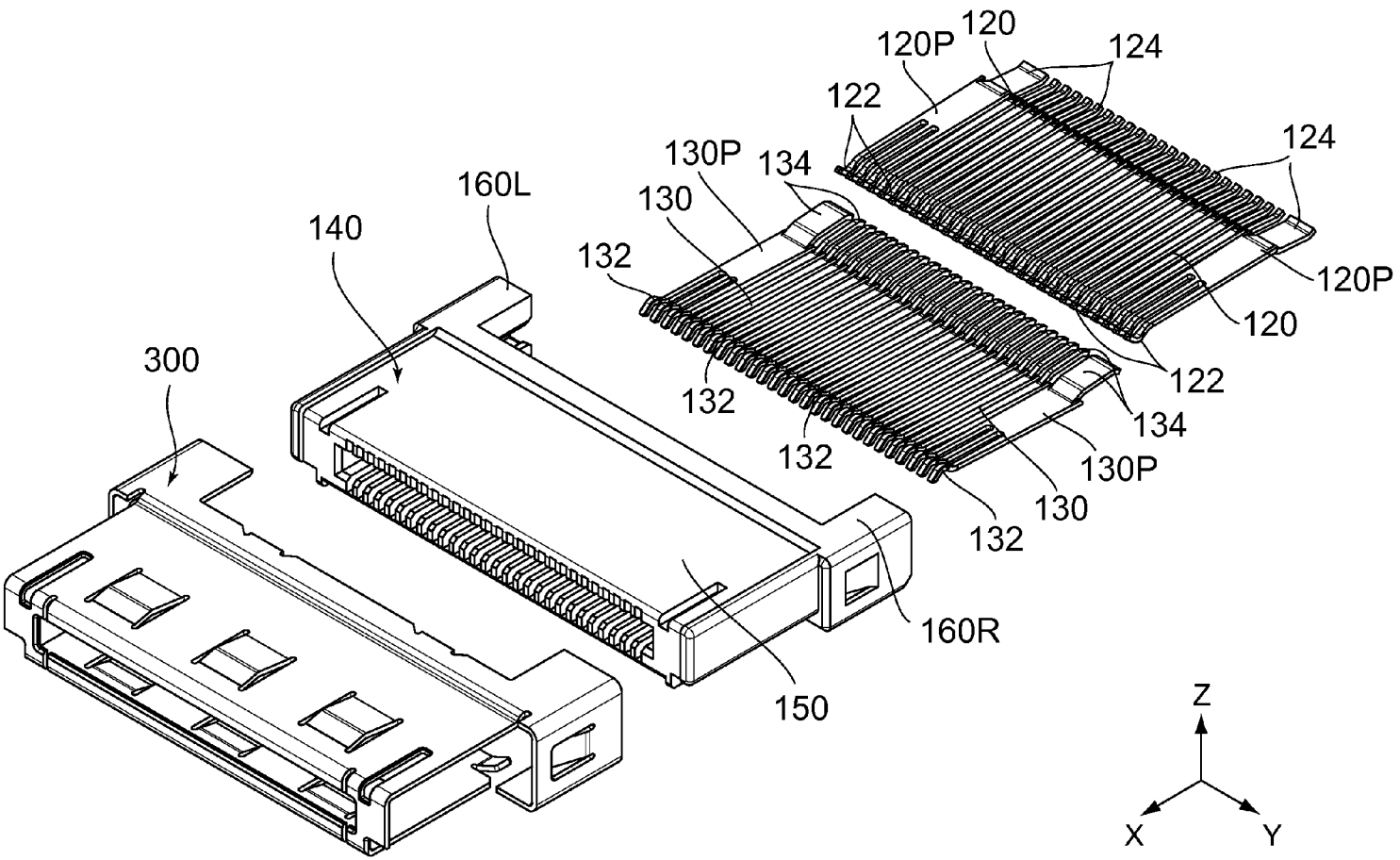
FIG. 5 is an exploded, perspective view showing the connector of FIG. 1.

As shown in FIG. 5, each of the upper contacts 120 has a front contact portion 122 and a rear contact portion (contact portion) 124. Each of the upper contacts 120P is a power contact and is wider than the upper contact 120. Each of the upper contacts 120P according to the present embodiment has three front contact portions 122 and one rear contact portion 124. The front contact portion 122 of the upper contact 120P has a size same as that of the front contact portion 122 of the upper contact 120. In contrast, the rear contact portion 124 of the upper contact 120P is wider than the rear contact portion 124 of the upper contact 120. The front contact portion 122 is a part which is to be connected to and brought into contact with a contact portion (not shown) of the mating connector (not shown), and the rear contact portion 124 is a part which is to be connected to and brought into contact with the conductive pad 420 of the circuit board 400 (see FIG. 6).

Similarly, each of the lower contacts 130 has a front contact portion 132 and a rear contact portion (contact portion) 134. Each of the lower contacts 130P is a power contact and is wider than the lower contact 130. Each of the lower contacts 130P according to the present embodiment has three front contact portions 132 and one rear contact portion 134. The front contact portion 132 of the lower contact 130P has a size same as that of the front contact portion 132 of the lower contact 130. In contrast, the rear contact portion 134 of the lower contact 130P is wider than the rear contact portion 134 of the lower contact 130. The front contact portion 132 is a part which is to be connected to and brought into contact with the contact portion (not shown) of the mating connector (not shown), and the rear contact portion 134 is a part which is to be connected to and brought into contact with the conductive pad 420 of the circuit board 400 (see FIG. 6).

Figure 7:
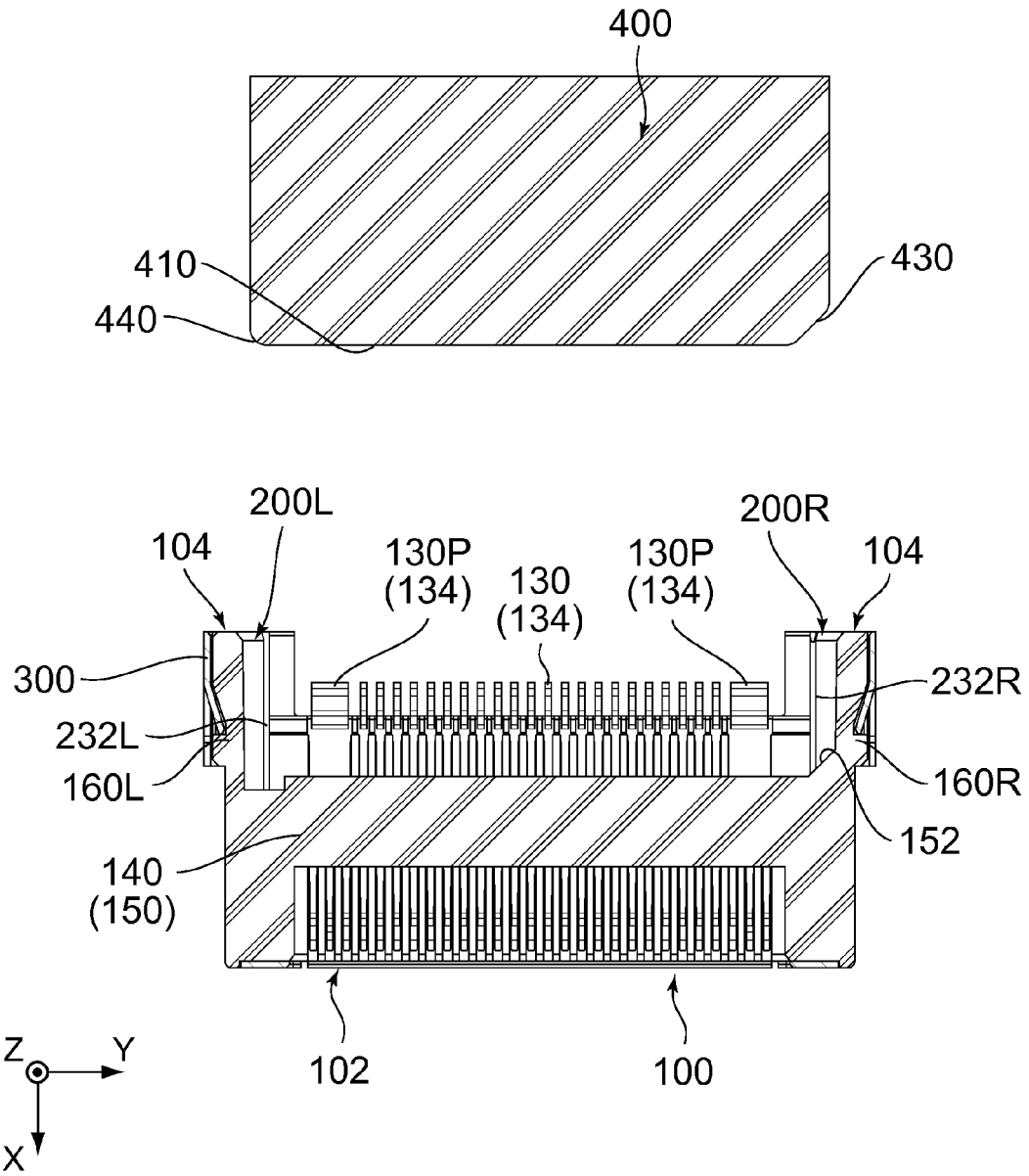
FIG. 7 is a cross-sectional view showing the connector of FIG. 4 together with the circuit board, taken along line VII-VII.

As shown in FIG. 5, the holding member 140 has a holding portion 150 and two rear arms 160R and 160L which extend in the negative X-direction (rearward) from the holding portion 150. The holding member 140 according to the present embodiment is a resin molded product. As shown in FIG. 7, the holding member 140 further has an incorrect insertion prevention portion 152. The incorrect insertion prevention portion 152 corresponds to the insertion key 430 of the circuit board 400 and is provided in order to prevent incorrect insertion, or insertion of the circuit board 400 with incorrect attitude. In detail, the incorrect insertion prevention portion 152 has a sloping shape corresponding to that of the insertion key 430 and is located at a position corresponding to that of the insertion key 430, or located in the vicinity of a boundary between the holding portion 150 and the rear arm 160R. If the circuit board 400 is forced to be inserted with an upside down attitude, the chamfer 440 is brought into abutment with the incorrect insertion prevention portion 152 so that the circuit board 400 cannot be completely connected to the connector 100. As described above, the insertion key 430 and the incorrect insertion prevention portion 152 prevent the incorrect insertion of the circuit board 400.

Figure 2:
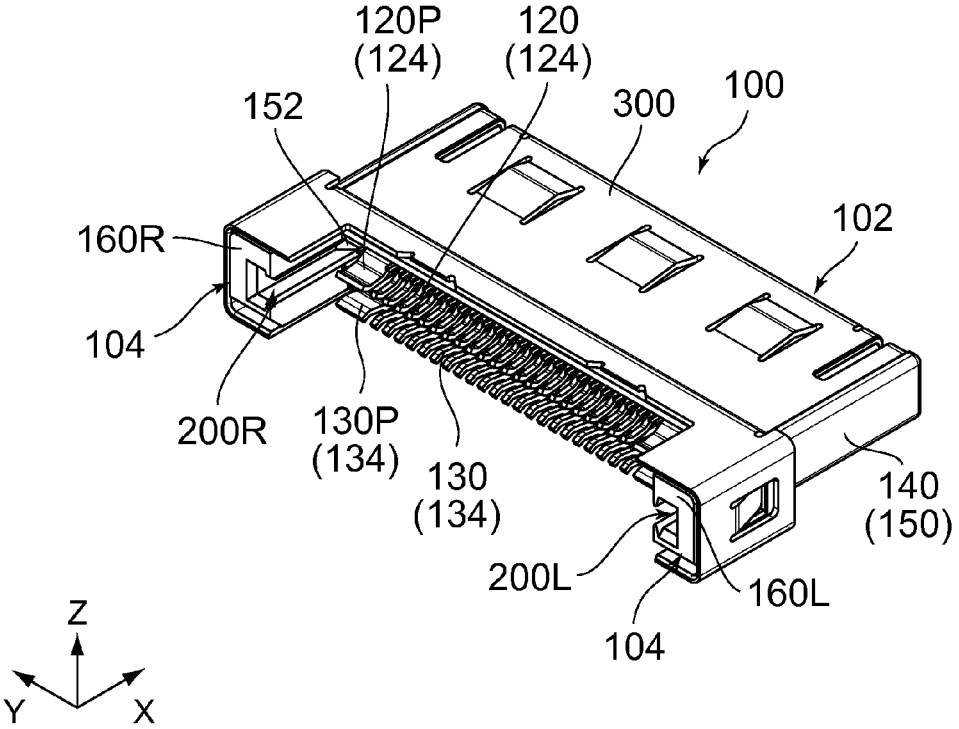
FIG. 2 is a rear perspective view showing the connector of FIG. 1.
Figure 3:
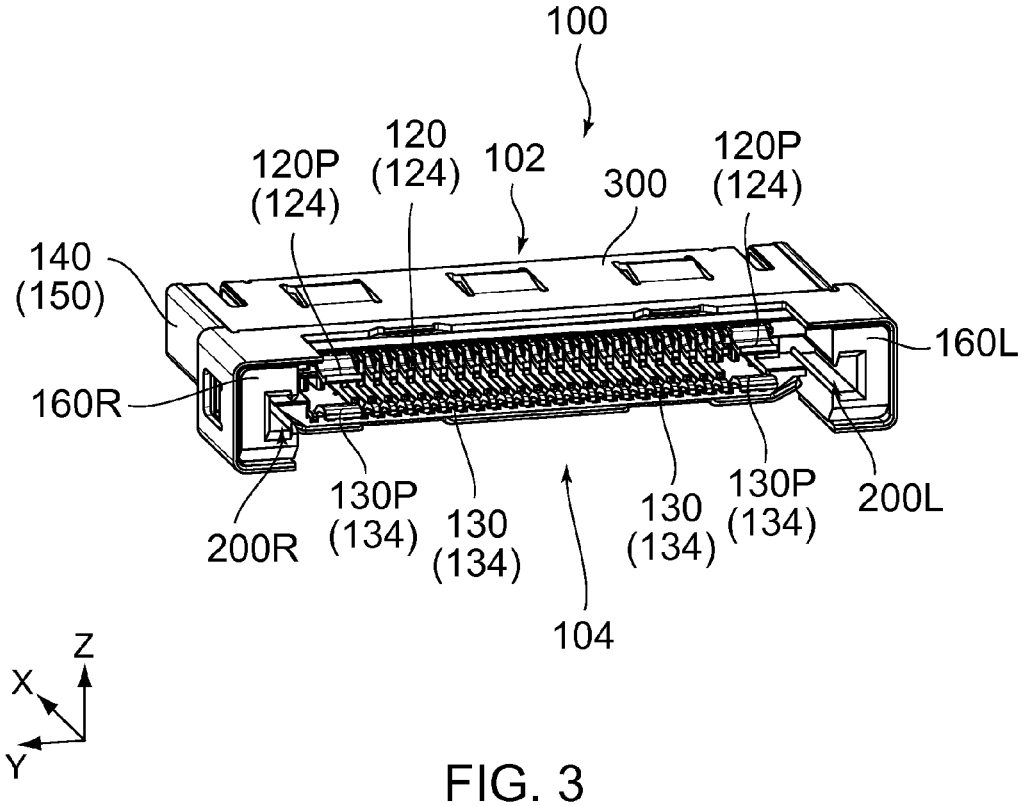
FIG. 3 is another rear perspective view showing the connector of FIG. 1.
Figure 4:
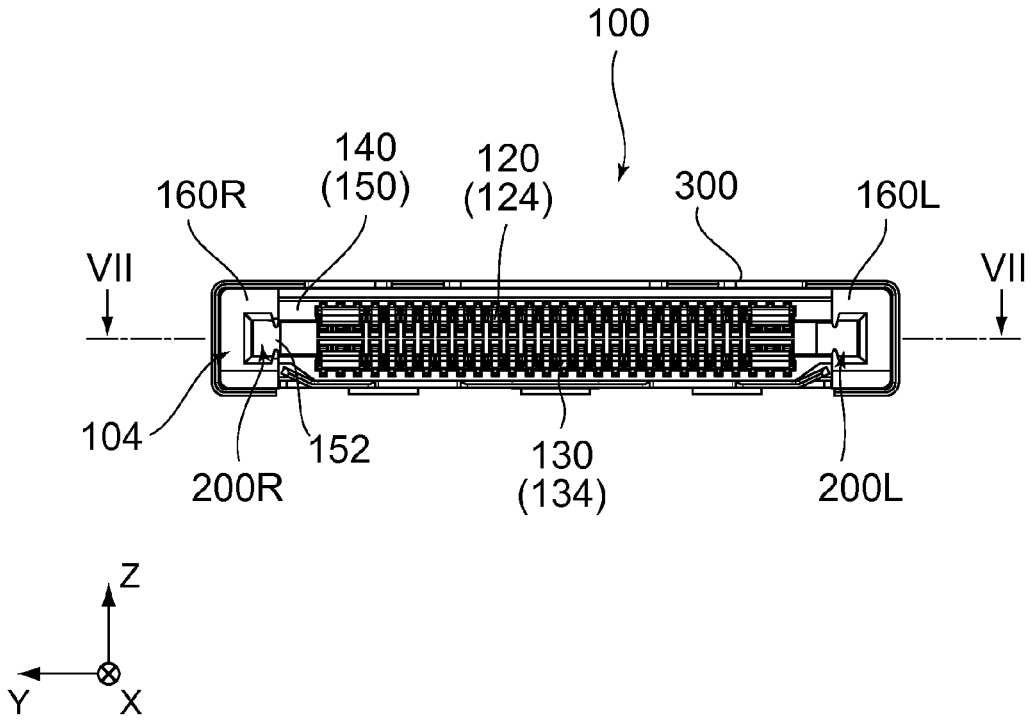
FIG. 4 is a rear view showing the connector of FIG. 1.

As can be seen from FIGS. 1 to 5, the holding portion 150 holds the upper contacts 120 and 120P and the lower contacts 130 and 130P. As shown in FIGS. 2 to 4, the upper contacts 120 are located between the two upper contacts 120P in the Y-direction, and the lower contacts 130 are located between the two lower contacts 130P in the Y-direction. The upper contacts 120 and 120P correspond to the lower contacts 130 and 130P, respectively. Moreover, the upper contacts 120 and 120P are mirror images of the lower contacts 130 and 130P. In detail, the upper contacts 120 and 120P form an upper contact set, and the lower contacts 130 and 130P form a lower contact set. A horizontal plane is defined by the X-direction and the Y-direction, wherein the horizontal plane is equally distant from the upper contact set and the lower contact set in the Z-direction. In other words, a distance between the upper contact set and the horizontal plane in the Z-direction is equal to another distance between the lower contact set and the horizontal plane in the Z-direction. The upper contacts 120 and 120P are arranged mirror symmetrically to the lower contacts 130 and 130P with respect to the horizontal plane, respectively. As can be seen from FIGS. 1 to 5, the front contact portions 122 and the front contact portions 132 are located within the mating portion 110, or more specifically, within the holding portion 150. As shown in FIGS. 2 to 4, the rear contact portions 124 and the rear contact portions 134 project rearward from the holding portion 150.

As shown in FIGS. 2 to 4, the rear arms 160R and 160L are located away from each other in the Y-direction. As can be seen from FIGS. 2 to 4, 6 and 7, the rear contact portions 124 and the rear contact portions 134 are located between the rear arms 160R and 160L in the Y-direction.

As shown in FIGS. 2 to 4 and 7, the rear arm 160R is formed with a first guide portion 200R, and the rear arm 160L is formed with a second guide portion 200L. Accordingly, the holding member 140 has the first guide portion 200R and the second guide portion 200L which are arranged away from each other in the Y-direction. As can be seen from FIG. 7, the incorrect insertion prevention portion 152 is nearer to the first guide portion 200R than to the second guide portion 200L. In other words, a distance between the incorrect insertion prevention portion 152 and the first guide portion 200R is shorter than another distance between the incorrect insertion prevention portion 152 and the second guide portion 200L.

The first guide portion 200R and the second guide portion 200L not only guide the insertion of the circuit board 400 into the connector 100 but also position the circuit board 400 in the connector 100 while considering manufacturing tolerances for the circuit board 400, particularly, variation in thickness of the circuit board 400. In particular, as described later, the first guide portion 200R and the second guide portion 200L according to the present embodiment hold the circuit board 400 when the circuit board 400 has a size, or a thickness, which is within the manufacturing tolerances but is larger than or equal to a predetermined size.

Figure 8:
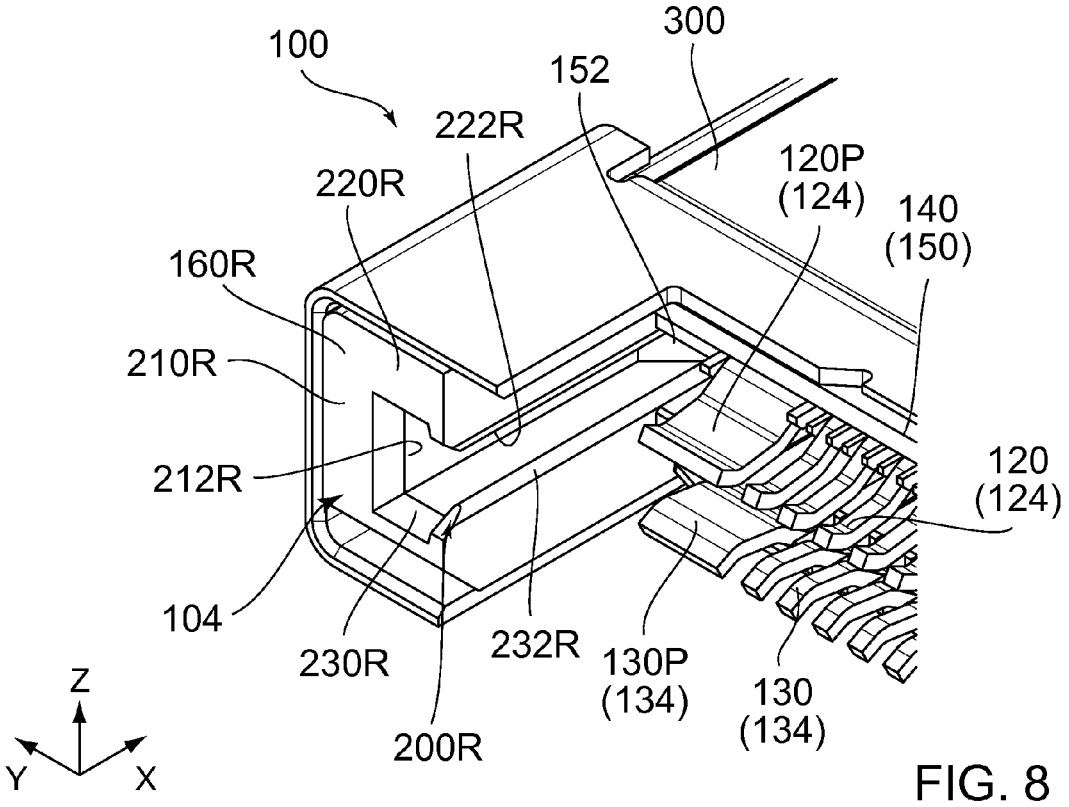
FIG. 8 is an enlarged, perspective view showing a first guide portion and its surroundings of the connector of FIG. 2.
Figure 9:
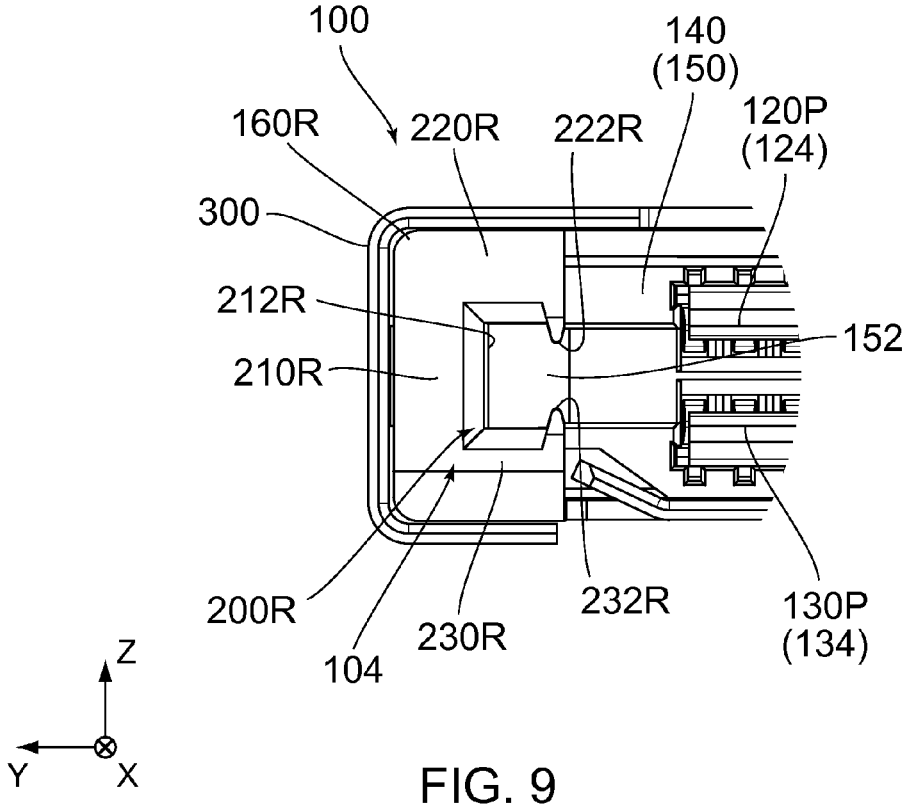
FIG. 9 is an enlarged, rear view showing the first guide portion and its surroundings of the connector of FIG. 4.

As shown in FIGS. 8 and 9, the first guide portion 200R has a side portion 210R, an upper portion 220R and a lower portion 230R which roughly form an angular C-like shape in a perpendicular plane perpendicular to the front-rear direction, or in the YZ-plane. More specifically, the upper portion 220R and the lower portion 230R protrude inward in the Y-direction from opposite ends of the side portion 21 OR in the Z-direction (upper-lower direction), respectively, and face each other in the Z-direction while being away from each other in the Z-direction. In detail, in the first guide portion 200R, the side portion 210R, the upper portion 220R and the lower portion 230R are formed as described below. The side portion 21 OR intersects with the Y-direction and is provided with a side surface 212R facing inward in the Y-direction. Each of the upper portion 220R and the lower portion 230R intersects with the Z-direction. The upper portion 220R is provided with a projection portion 222R. The projection portion 222R is located away from the side surface 212R and projects downward, or in the negative Z-direction. In other words, the projection portion 222R projects inward in the Z-direction. The thus-formed projection portion 222R and the side surface 212R has a gap or a space formed therebetween. Similarly, the lower portion 230R is provided with a projection portion 232R. The projection portion 232R is located away from the side surface 212R and projects upward, or in the positive Z-direction. In other words, the projection portion 232R projects inward in the Z-direction. The thus-formed projection portion 232R and the side surface 212R has a gap or a space formed therebetween.

Figure 10:
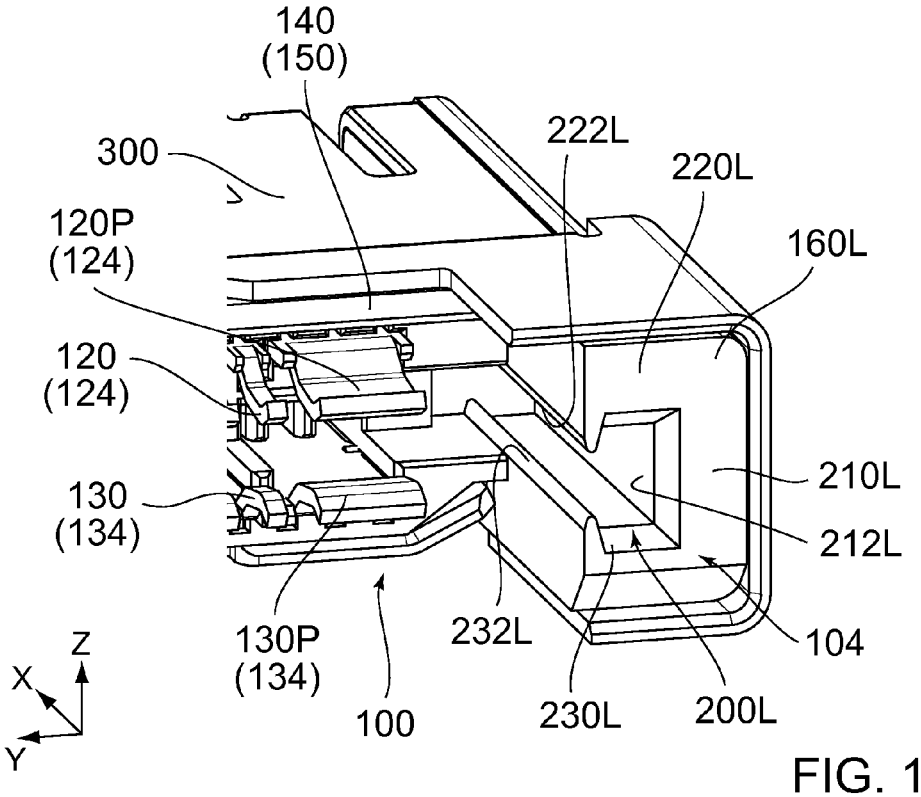
FIG. 10 is an enlarged, perspective view showing a second guide portion and its surroundings of the connector of FIG. 3.
Figure 11:
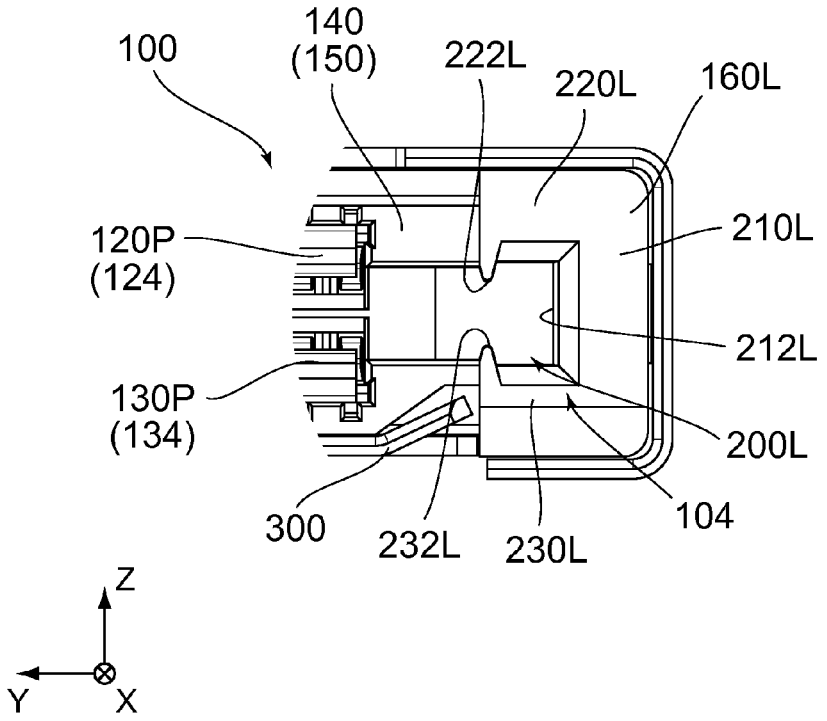
FIG. 11 is an enlarged, rear view showing the second guide portion and its surroundings of the connector of FIG. 4.
Figure 12:
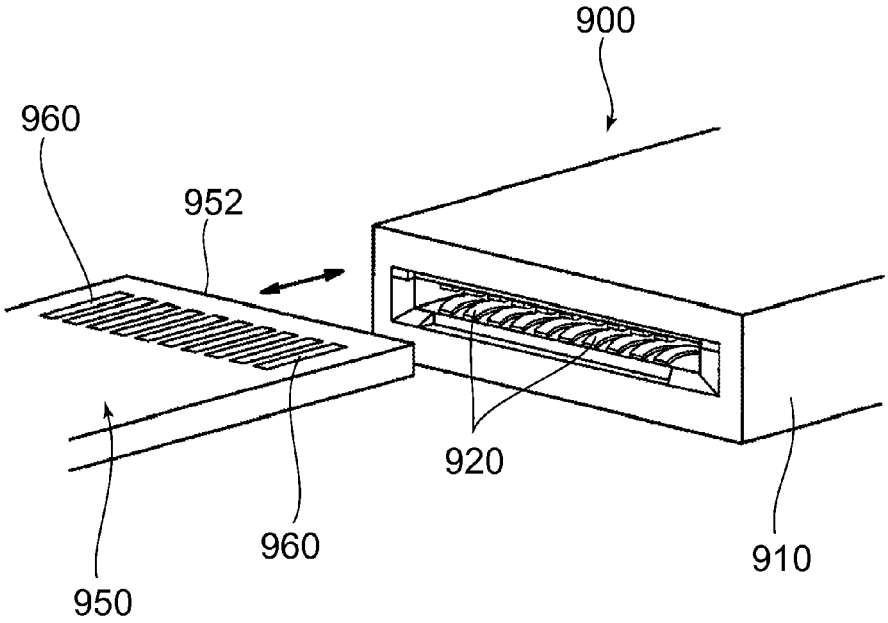
FIG. 12 PRIOR ART
FIG. 12 is a perspective view showing a connector of Patent Document 1.
Figure 13:
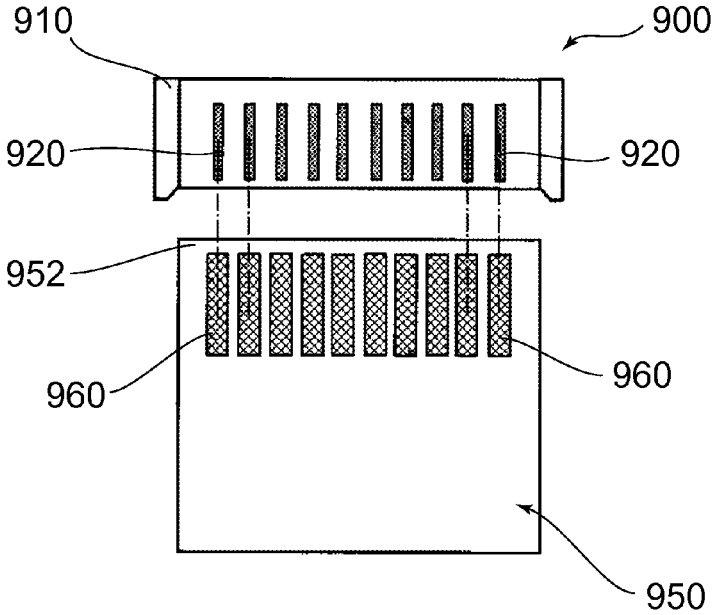
FIG. 13 PRIOR ART
FIG. 13 is a schematic view showing an arrangement of contacts and conductive pads of Patent Document 1.

As shown in FIGS. 10 and 11, the second guide portion 200L has a side portion 210L, an upper portion 220L and a lower portion 230L which roughly form an angular C-like shape in the YZ-plane. More specifically, the upper portion 220L and the lower portion 230L protrude inward in the Y-direction from opposite ends of the side portion 210L in the Z-direction, respectively, and face each other in the Z-direction while being away from each other in the Z-direction. In detail, in the second guide portion 200L, the side portion 210L, the upper portion 220L and the lower portion 230L are formed as described below similar to those in the first guide portion 200R. The side portion 210L intersects with the Y-direction and is provided with a side surface 212L facing inward in the Y-direction. Each of the upper portion 220L and the lower portion 230L intersects with the Z-direction. The upper portion 220L is provided with a projection portion 222L. The projection portion 222L is located away from the side surface 212L and projects in the negative Z-direction. The thus-formed projection portion 222L and the side surface 212L has a gap or a space formed therebetween. Similarly, the lower portion 230L is provided with a projection portion 232L. The projection portion 232L is located away from the side surface 212L and projects in the positive Z-direction. The thus-formed projection portion 232L and the side surface 212L has a gap or a space formed therebetween.

The holding member 140 according to the present embodiment is formed by using two metal molds which are dividable into front and rear. Accordingly, each of the projection portions 222R, 232R, 222L and 232L extends long in the front-rear direction, or in the X-direction. However, the present invention is not limited thereto. For example, each of the projection portions 222R, 232R, 222L and 232L may be formed of a plurality of projections arranged in the X-direction or may extend shorter in the X-direction.

As shown in FIGS. 9 and 11, each of the projection portions 222R, 232R, 222L and 232L is thin. In detail, as shown in FIG. 9, in the first guide portion 200R, a size of each of the projection portions 222R and 232R in the Y-direction is not more than one third of another size of the side surface 212R in the Z-direction. As shown in FIG. 11, in the second guide portion 200L, a size of each of the projection portions 222L and 232L in the Y-direction is not more than one third of another size of the side surface 212L in the Z-direction. Moreover, each of the projection portions 222R, 232R, 222L and 232L according to the present embodiment has a tapered shape in the perpendicular plane, or in the YZ-plane.

Referring to FIGS. 7, 8 and 10, since the projection portions 222R, 232R, 222L and 232L are provided, a position, particularly a position in the Z-direction, of the circuit board 400 in the connector 100 is limited as compared with a case where the projection portions 222R, 232R, 222L and 232L are not provided. In other words, the connector 100 according to the present embodiment can restrict a movement of the circuit board 400 in the connector 100 to improve positioning accuracy of a circuit board 400 in the connector 100. In detail, if the size of the circuit board 400 (more specifically, the thickness, or the size in the Z-direction of the circuit board 400) is large within the manufacturing tolerances in the case where the projection portions 222R, 232R, 222L and 232L are not provided, the circuit board 400 might be intensively pressed against inner surfaces of the first guide portion 200R and the second guide portion 200L so that the circuit board 400 might not to be inserted into the connector 100. However, as previously described, each of the projection portions 222R, 232R, 222L and 232L according to the present embodiment has the gap or the space formed therearound. When the size, or the thickness, of the circuit board 400 is large, the projection portions 222R, 232R, 222L and 232L are deformed to be partially moved into the gap or the space. Accordingly, even if the size, or the thickness, of the circuit board 400 is large within the manufacturing tolerances, the circuit board 400 can be inserted into the connector 100. Moreover, after the circuit board 400 is inserted in the connector 100 under a condition where the projection portions 222R, 232R, 222L and 232L are deformed, the connector 100 is held by the projection portions 222R, 232R, 222L and 232L. Accordingly, the circuit board 400 can be more securely positioned in the connector 100.

In particular, as described above, the size of each of the projection portions 222R, 232R, 222L and 232L in the Y-direction is not more than one third of the size of each of the side surfaces 212R and 212L in the Z-direction. Every one of the projection portions 222R, 232R, 222L and 232L is thin to be relatively easily deformed even when the size of the circuit board 400 is large. Accordingly, even when the circuit board 400 has a large size, the circuit board 400 can be relatively easily inserted into the connector 100 while being positioned by the projection portions 222R, 232R, 222L and 232L.

Moreover, every one of the projection portions 222R, 232R, 222L and 232L according to the present embodiment has the tapered shape in the YZ-plane. Accordingly, even when the circuit board 400 has a large size, the projection portions 222R, 232R, 222L and 232L can be deformed just as much as necessary so as to receive the circuit board 400. Since the projection portions 222R, 232R, 222L and 232L are deformed in association with the insertion of the circuit board 400, the circuit board 400 is sandwiched between and held by the deformed projection portions 222R, 232R, 222L and 232L. Even in a case where some of the projection portions 222R, 232R, 222L and 232L are not provided, the circuit board 400 can be held similarly. However, from a view point of reducing the maximum deformed amount of each of the projection portions 222R, 232R, 222L and 232L, the projection portions 222R, 232R, 222L and 232L are preferred to be provided similar to the present embodiment.

Referring to FIGS. 4, 9 and 11, a vertical plane, or a plane perpendicular to the Y-direction, is defined by the X-direction and the Z-direction, wherein the vertical plane is equally distant from the side surface 212R and the side surface 212L in the Y-direction. In other words, a distance between the side surface 212R and the vertical plane in the Y-direction is equal to another distance between the side surface 212L and the vertical plane in the Y-direction. As can be seen from FIGS. 4, 9 and 11, the first guide portion 200R and the second guide portion 200L according to the present embodiment have structures symmetrical to each other in the Y-direction with respect to this vertical plane. More specifically, the projection portion 222R and the projection portion 222L are arranged symmetrically with each other with respect to the vertical plane. Similarly, the projection portion 232R and the projection portion 232L are arranged symmetrically with each other with respect to the vertical plane. Accordingly, the projection portions 222R, 232R, 222L and 232L are available even for a reverse insertion, or the insertion of the circuit board 400 with the upside down attitude. However, in order for the circuit board 400 to be actually inserted with the upside down attitude, some portions such as the incorrect insertion prevention portion 152 that interferes the reverse insertion needs to be omitted. If the circuit board 400 is thus formed, the circuit board 400 can be inserted with the upside down attitude in correspondence with an arrangement of the conductive pads 420 on the circuit board 400.

As can be seen from FIG. 7, in the present embodiment, the negative X-side end (rear end) of each of the projection portions 222R, 222L, 232R and 232L is located rearward, or toward the negative X-side, of the rear contact portions 124 and 134. Accordingly, the circuit board 400 is brought into abutment with neither the upper contacts 120 and 120P nor the lower contacts 130 and 130P before being inserted between the projection portions 222R and 222L and the projection portions 232R and 232L.

Although the explanation is already made about the present invention while referring to the specific structure, the present invention is not limited thereto.

For example, in the aforementioned embodiment, the connector 100 includes the projection portions 222R and 222L projecting from the upper portions 220R and 220L and the projection portions 232R and 232L projecting from the lower portions 230R and 230L. In other words, the projection portions project from the upper portion and the lower portion, respectively. However, the projection portions may project only from one of the upper portion and the lower portion. In other words, it is sufficient that at least one of the upper portion and the lower portion is provided with the projection portion.

As shown in FIGS. 7, 8 and 10, in the present embodiment, each of projection portions 222R, 232R, 222L and 232L extends to the rear end 104 of the connector 100. However, each of projection portions 222R, 232R, 222L and 232L does not need to extend to the rear end 104. In other words, each of projection portions 222R, 232R, 222L and 232L may extend forward from a position which is away forward from the rear end 104.

The present application is based on a Japanese patent application of JP2014-013011 filed before the Japan Patent Office on Jan. 28, 2014, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector which has a rear end in a front-rear direction and is connected with a circuit board when the circuit board is inserted into the connector through the rear end along the front-rear direction, wherein:

the connector comprises a plurality of contacts and a holding member holding the contacts;

the holding member has a first guide portion and a second guide portion which are arranged away from each other in a pitch direction perpendicular to the front-rear direction;

each of the first guide portion and the second guide portion has an upper portion and a lower portion;

in each of the first guide portion and the second guide portion, each of the upper portion and the lower portion intersects with an up-down direction perpendicular to both the front-rear direction and the pitch direction, and each of the upper portion and the lower portion is provided with a projection portion, which projects toward a position between the upper portion and the lower portion in the up-down direction;

each of the first guide portion and the second guide portion further has a side portion;

in each one of the first guide portion and the second guide portion, the side portion intersects with the pitch direction and is provided with a side surface facing toward the other of the first guide portion and the second guide portion in the pitch direction;

in each of the first guide portion and the second guide portion, the projection portion is away from the side surface;

the plurality of the contacts include a plurality of upper contacts and a plurality of lower contacts; and the upper contacts are arranged mirror symmetrically to the lower contacts with respect to a horizontal plane perpendicular to the up-down direction, respectively.

2. The connector as recited in claim 1, wherein, in each of the first guide portion and the second guide portion, a size of the projection portion in the pitch direction is not more than one third of a size of the side surface in the up-down direction.

3. The connector as recited in claim 1, wherein:

the connector has a mating portion which is to be mated with a mating connector; and the mating portion is located toward a front end of the connector.

4. The connector as recited in claim 1, wherein, each of the projection portions extends long in the front-rear direction.

5. The connector as recited in claim 1, wherein:

each of the projection portions has a tapered shape in a perpendicular plane perpendicular to the front-rear direction.

* * * * *